US007630676B2

(12) United States Patent
Pirwitz

(10) Patent No.: US 7,630,676 B2
(45) Date of Patent: Dec. 8, 2009

(54) SELF-LOADING BELT FUSING APPARATUS

(75) Inventor: Robert G Pirwitz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 505 days.

(21) Appl. No.: 11/567,379

(22) Filed: Dec. 6, 2006

(65) Prior Publication Data

US 2008/0138128 A1 Jun. 12, 2008

(51) Int. Cl.
*G03G 15/16* (2006.01)
*G03G 15/29* (2006.01)

(52) U.S. Cl. ..... 399/329; 399/122

(58) Field of Classification Search ..... 399/122, 399/328–330

See application file for complete search history.

(56) References Cited

U.S. PATENT DOCUMENTS 5,895,153 A 4/1999 Aslam et al.
6,026,274 A 2/2000 Aslam et al.
6,650,863 B2 * 11/2003 Fuma ..... 399/329
6,818,290 B1 11/2004 Chopra et al.
6,879,803 B2 4/2005 Gogate et al.
2004/0042829 A1 * 3/2004 Pirwitz ..... 399/329

* cited by examiner

*Primary Examiner*—David M Gray
*Assistant Examiner*—Joseph S Wong
(74) *Attorney, Agent, or Firm*—Edward A. Brown; Prass LLP

(57) ABSTRACT

A self-loading belt fusing apparatus is provided and includes (a) a frame; (b) a first rotatable roller having a first outer surface and a first mounted position on the frame; (c) a second rotatable roller having a second outer surface, and a second mounted position on the frame spaced from the first mounted position of the first rotatable roller, the second outer surface and the first outer surface being spaced a first dimension from each other and defining an operating gap therebetween; and (d) an endless resilient belt hoop having an inner surface, an external surface, an unloaded external diameter, and a loaded external diameter that is less than the unloaded external diameter, the endless resilient belt hoop being pinched-loaded into the operating gap by the first outer surface of the first roller and the second outer surface of the second roller, and the endless resilient belt hoop, as pinch-loaded, forming a self-loading fusing nip with at least one of the first roller and the second roller.

20 Claims, 2 Drawing Sheets

SELF-LOADING BELT FUSING APPARATUS

Figure 1:
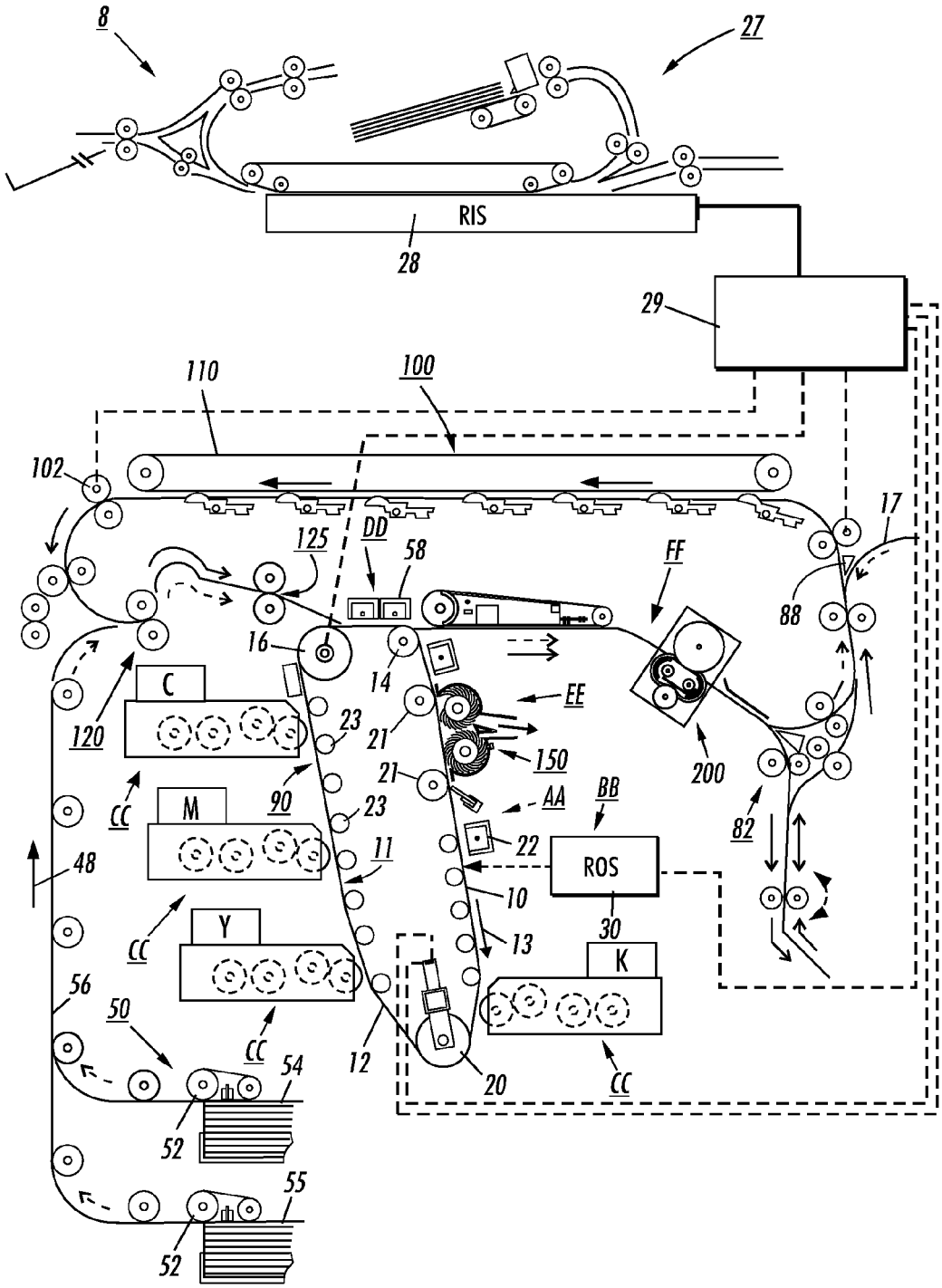

The present invention relates to an electrostatographic reproducing machine and, more particularly, to such a machine including a self-loading belt fusing apparatus.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in imagewise configuration is separated from the photoreceptor and moved through a fuser apparatus to permanently fix or fuse the toner image to the paper.

One approach to fixing, or "fusing," the toner image is applying heat and pressure by passing the copy sheet carrying the unfused toner image between a pair of opposed rotatably movable members (that include rollers and belts) of a fusing apparatus, at least one of which is heated. During this procedure, the temperature of the toner material is elevated to a temperature at which the toner material coalesces and becomes tacky. This heating causes the toner to flow to some extent into the fibers or pores of the sheet. Thereafter, as the toner material cools, solidification of the toner material causes the toner material to become bonded to the sheet.

Examples of such fusing apparatus are disclosed in U.S. Pat. No. 6,879,803 issued Apr. 12, 2005 and entitled "Belt fuser for a color electrophotographic printer" discloses a fuser for fusing an image to print media in a color electrophotographic printer. The fuser includes an endless idling belt defining an inner loop, and a ceramic heater positioned in contact with the belt, within the inner loop. A pressure roller defines a nip with the belt. The belt includes a compliant layer for conforming to variations in toner pile height. The heater is configured to provide a cooler nip exit and a hotter nip entrance.

U.S. Pat. No. 6,818,290 issued Nov. 16, 2004 and entitled "Belt fuser belt" a fuser belt (1) of polyimide incorporating surface-oxidized boron nitride. The resulting enhanced flexibility provides continuing strength without physical damage during use of the belt in a belt fuser while thermal conductivity is preserved. The extent of flexibility enhancement observed is dependent on the degree of oxidation. Therefore, oxidation temperature and time of oxidation are key variables that are used to control the degree of oxidation and thereby the resulting improvement in the flex fatigue.

U.S. Pat. No. 5,895,153 issued Apr. 20, 1999 and entitled "Mechanism for tracking the belt of a belt fuser" discloses reproduction apparatus where a colorant image is formed on a receiver member, and the colorant image is fixed on the receiver member by a belt fusing apparatus for providing image gloss to such colorant image. The belt fusing apparatus includes a heated fuser roller, a pressure roller in nip relation with the fuser roller, a steering roller, and a fusing belt entrained about the fuser roller and the steering roller for movement in a predetermined direction about a closed loop path. A mechanism is provided for accurately controlling the tracking of the fusing belt. The fusing belt tracking control mechanism includes supports the steering roller for rotation about its longitudinal axis, and for casterred and gimbaled movement. Sensors detect the respective lateral edges of the fusing belt, the sensors producing control signals when the respective lateral edges are detected for effecting casterred movement of the steering roller. Accordingly, the fusing belt is continuously progressively moved in a cross-track direction between lateral limits.

U.S. Pat. No. 6,026,274 issued Feb. 15, 2000 and entitled "Collapsible readily replaceable belt fuser assembly" discloses belt fusing apparatus for use in a reproduction apparatus where a colorant image is formed on a receiver member, and the colorant image is fixed on the receiver member by the belt fusing apparatus for providing image gloss to such colorant image. The belt fusing apparatus includes a fuser assembly and a pressure roller operative associated with the fuser assembly. The fuser assembly includes a fuser roller, a mechanism for supporting the fuser roller, a steering roller, and a mechanism for supporting the steering roller. A member pivotably interconnects the fuser roller support mechanism and the steering roller support mechanism so that the fuser roller support mechanism can move relative to the steering roller support mechanism to and from operative an association therebetween and a collapsed position to facilitate accessibility, serviceability, and ready replacement of a fusing belt adapted to be entrained about the fuser roller and the steering roller for movement in a predetermined direction about a closed loop path.

Conventional fusing apparatus such and those like the disclosed examples above typically include complex sub components including belt tracking and spring nip loading mechanism which add to the bulk complexity and cost of the apparatus. As such, conventional fusing apparatus tend to suffer from problems and drawbacks such as poor warm-up times, poor thermal efficiency, significant temperature drooping, and relatively high friction nip area, such as are common and inherent in ceramic heater/belt type fusing apparatus.

In accordance with the present disclosure, there has been provided a self-loading belt fusing apparatus that includes (a) a frame; (b) a first rotatable roller having a first outer surface and a first mounted position on the frame; (c) a second rotatable roller having a second outer surface, and a second mounted position on the frame spaced from the first mounted position of the first rotatable roller, the second outer surface and the first outer surface being spaced a fixed dimension from each other and defining an operating gap therebetween; and (d) an endless resilient belt hoop having an inner surface, an external surface, an unloaded external diameter, and a loaded external dimension that is less than the unloaded external diameter, the endless resilient belt hoop being pinched-loaded into the operating gap by the first outer surface of the first roller and the second outer surface of the second roller, and the endless resilient belt hoop, as pinch-loaded, forming a self-loading fusing nip with at least one of the first roller and the second roller.

Figure 2:
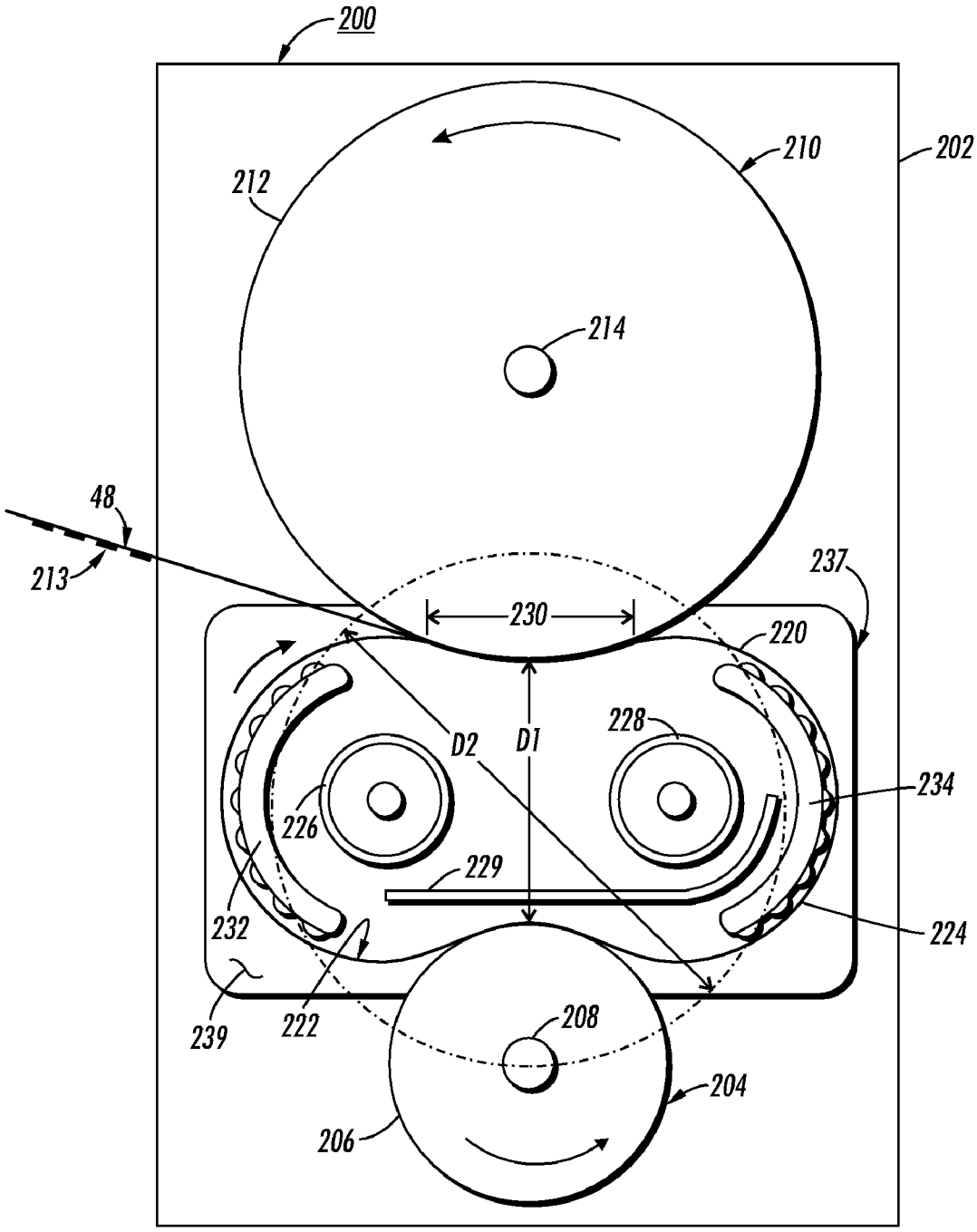

FIG. 1 is a schematic elevational view of an exemplary electrostatographic reproduction machine including a self-loading belt fusing apparatus in accordance with the present disclosure; and FIG. 2 is an enlarged end schematic of the self-loading belt fusing apparatus of FIG. 1.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed and registered manner. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF. Fusing station FF includes the self-loading belt fusing apparatus of the present disclosure shown generally as 200 (to be described in detail below) for fusing and permanently affixing the transferred toner powder image 213 to the copy sheet 48.

After that, the sheet 48 then passes to a gate 88 that either allows the sheet to move directly via output 17 to a finisher or stacker, or deflects the sheet into the duplex path 100. Specifically, the sheet (when to be directed into the duplex path 100) is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 200 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Referring now to FIGS. 1-2, the self-loading belt fusing apparatus 200 as shown includes (a) a frame 202; (b) a first rotatable roller 204 (which can be an idler roller) having a first outer surface 206 and a first mounted position 208 on the frame; (c) a second rotatable roller 210 (which can be a drive roller and the pressure roller) having a second outer surface 212, and a second mounted position 214 on the frame that is spaced from the first mounted position 208 of the first rotatable roller. The second outer surface 212 and the first outer surface 206 are spaced a fixed dimension D1 from each other and define an operating gap between them as shown. The self-loading belt fusing apparatus 200 also includes (d) an endless resilient belt hoop 220 that is made of a heat conductive material, that is semi-rigid and springy, for example stainless steel. For fusing purposes the steel belt may be coated in order to improve image release therefrom.

As shown, the belt hoop 220 has an inner surface 222, an external surface 224, an unloaded external diameter D2 giving it a generally circular shape as shown by the dotted circle. When loaded and pinched between the first and second rollers 204 and 210, the endless belt hoop 220 then has a loaded external dimension (now D1) that is significantly less than the unloaded external diameter D2. As shown, the endless resilient belt hoop 220 is pinched-loaded into the operating gap by the first outer surface 206 of the first roller 204, and by the second outer surface 212 of the second roller 210. The endless resilient belt hoop 220 pinch-loaded as such functions as a hoop compression spring, exerting equal and opposite forces to the rollers, 204 and 210. The endless resilient belt hoop 220, as pinch-loaded, thus forms a self-loading fusing nip 230 with at least one of the first roller and the second roller 204, 210, for example it is shown forming the nip with the second roller 210.

The self-loading belt fusing apparatus 200 also includes at least one heating element 226, 228 for heating the endless resilient belt hoop 220, and a heat reflector 229 that is mounted adjacent the at least one heating element for reflecting and concentrating heat energy from the at least one heating element to a desired portion (for example the fusing nip 230 and pre-nip portions) of the endless resilient belt hoop. The heating elements 226, 228 can be located inside the loop defined by the inner surface 222 of the endless resilient belt hoop, but the belt hoop can also be heated externally for example by heating rollers 204 and/or 210 directly.

To externally heat the endless belt hoop with the rollers 204 and/or 210 as such, the rollers 204 and/or 210 can be used as heat pipes. This means each roller 204 and/or 210 will be adapted in a well known manner to be a device that is heated, and that redistributes heat in the axial direction for the purpose of moving heat from overheated areas of a fuser, typically outside the paper path, to relatively cooler areas inside the paper path. The self-loading belt fusing apparatus of the present disclosure uniquely lends itself to integrating heat pipes as such into the system without increasing the number of parts. Use of heat pipes as such also addresses a common overheating problem often encountered with conventional ceramic heater/belt type fusers that attempt to address the problem by using a reduced fuser temperature and reduced process speed (typically by ½) in order to run narrow paper.

Referring again to FIGS. 1 and 2, the first mounted position 208 of the first roller 204 is fixed, and the second mounted position 214 of the second roller 210 may be adjustable relative to the first mounted position 208 of the first roller. In other words, the second mounted position 214 of the second roller may be adjustable relative to the first mounted position 208 of the first roller in order to enable desired loading of the endless resilient belt hoop within the operating gap. The second roller 210 may have an external diameter that is different from (as shown) or equal to an external diameter of the first roller 204.

The self-loading belt fusing apparatus 200 also includes at least one drive means (not shown) that is coupled to at least one of the first roller 204 and the second roller 210 as the drive roller, (with the other then being the idler roller), for moving the endless resilient belt hoop 220 as well as the other (idler of the first roller and the second roller) rotatably through the operating gap. The self-loading belt fusing apparatus further includes 2 belt guides, only one 237 of which is shown, that are mounted at each end of the rollers 204, 210. Each belt guide 237 has a flat thrust face 239 that functions to position and restrain the endless belt hoop in the proper axial location between the axial ends of the rollers 204, 210. Each belt guide 237 also includes a first and second guide baffle 232, 234 as shown that extend axially a short (for example 5-20 mm) distance along the path of the belt as shown to keep the belt positioned between the 2 rollers. This use of the guide baffles counteracts the natural tendency of the driving roller to eject the belt out of the apparatus.

Thus to recap, the self-loading belt fusing apparatus 200 includes a suitable rigid frame 202, the first roller 204 that can be an idler roll that is mounted on bearings in a fixed first mounted position 208 to the frame 202, a second roller 210 that is then the pressure roll which is also mounted on bearings in a second mounted position 214 in the frame. The endless belt hoop 220 can be made of a coated, endless, semi-rigid, resilient material such as stainless steel, and mounted to function as the heated fuser member. As shown, it is circular in the free or unloaded state where it has a free or unloaded diameter D2, but it takes on the generally peanut-shape with a minor diameter-like dimension D1 as shown when assembled and pinch-loaded between the first roller 204 and the second roller 210 as shown. Pinch-loaded and driven as such, the endless resilient belt hoop 220 results in a self-loading nip forming fuser belt hoop by functioning as a spring to provide the necessary nip pressure for the fusing process. This is an advantage of the self-loading belt fusing apparatus 200 because it simplifies the fusing apparatus by eliminating the need for a conventional spring loading mechanism.

The self-loading belt fusing apparatus 200 further includes the at least one heating elements 226, 228 (that can be standard type fuser radiant heating lamps), and the belt guides 237 one at each end of the rollers 204, 210. Each of the belt guides 237 contains two guide baffles 232, 234 that extend only a small way along the path of the belt hoop as shown for guiding, limiting the lateral movement of, and constraining, the belt hoop 220 between the two rollers 204, 210. Each of the belt guide also contains a thrust face 239 that positions and restrains the belt axially.

The lamp reflector 229 can be tailored to direct the radiant energy to where it is needed. As illustrated, the reflector 229 is positioned to direct the heat to the fusing nip area or fusing nip portion, as well as to the pre-nip area, as shown thereof to pre-heat each portion of the belt 220 prior to it entering the fusing nip 230. The endless resilient belt hoop 220 pinch-loaded as disclosed to form the fusing nip 230 advantageously avoids or prevents high friction nip area that is inherent in conventional ceramic heater/belt type fusing apparatus. It also enables the use of several different types of first and second rollers 204, 210 as the idler and pressure rolls. For example, the pressure and idler rolls can be any combination of rigid, elastic, insulative, low mass, and/or coated material. Low mass and/or insulative rolls for example will substantially reduce warm-up time and temperature droop, as well as increase the thermal efficiency of the fusing apparatus. Furthermore, either or both the first roller 204 and the second roller 210 can be heat pipes to improve temperature uniformity axially across the fuser nip area. This is a distinct advantage over the conventional ceramic heater/belt type fusing apparatus that must drastically reduce process speed (by ½) when running narrow paper.

Additionally, either or both the first roller 204 and the second roller 210, can supply drive for the system. The external diameters of the first roller 204 and the second roller 210 are not restricted to the sizes or proportions shown, and may for example be equal. The belt material is heat conductive and can be, but is not limited to, thin stainless steel with a suitable outer coating for good toner release properties and a suitable inner coating for good absorption of radiant energy. Stainless steel may be preferable due to its good spring properties. Due to the rigidity of the belt, and lack of a high friction ceramic heater, no active tracking mechanism is needed.

As can be seen, there has been provided a self-loading belt fusing apparatus that includes (a) a frame; (b) a first rotatable roller having a first outer surface and a first mounted position on the frame; (c) a second rotatable roller having a second outer surface, and a second mounted position on the frame spaced from the first mounted position of the first rotatable roller, the second outer surface and the first outer surface being spaced a fixed dimension from each other and defining an operating gap therebetween; and (d) an endless resilient belt hoop having an inner surface, an external surface, an unloaded external diameter, and a loaded external dimension that is less than the unloaded external diameter, the endless resilient belt hoop being pinched-loaded into the operating gap by the first outer surface of the first roller and the second outer surface of the second roller, and the endless resilient belt hoop, as pinch-loaded, forming a self-loading fusing nip with at least one of the first roller and the second roller.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A self-loading belt fusing apparatus comprising:

(a) a frame;

(b) a first rotatable roller having a first outer surface and a first mounted position on said frame;

(c) a second rotatable roller having a second outer surface, and a second mounted position on said frame spaced from said first mounted position of said first rotatable roller, said second outer surface and said first outer surface being spaced a first dimension from each other and defining an operating gap therebetween; and (d) an endless resilient belt hoop having (i) an inner surface, (ii) an external surface, (iii) an unloaded external diameter, and (iv) a loaded external dimension that is less than said unloaded external diameter, said endless resilient belt hoop being pinched-loaded into said operating gap by said first outer surface of said first roller and said second outer surface of said second roller, said endless resilient belt hoop, as pinch-loaded, acting as a hoop compression spring and forming a self-loading fusing nip with at least one of said first roller and said second roller.

2. The self-loading belt fusing apparatus of claim 1, including first and second belt hoop guide baffles mounted adjacent portions of a path of said endless resilient belt hoop.

3. The self-loading belt fusing apparatus of claim 1, wherein said first mounted position of said first roller is fixed.

4. The self-loading belt fusing apparatus of claim 1, wherein said second mounted position of said second roller is adjustable relative to said first mounted position of said first roller.

5. The self-loading belt fusing apparatus of claim 1, wherein said endless resilient belt hoop is made of thin coated steel.

6. The self-loading belt fusing apparatus of claim 1, wherein said endless resilient belt hoop is made of a metallic material.

7. The self-loading belt fusing apparatus of claim 1, wherein one of said first roller and said second roller is a drive roller for moving said endless resilient belt hoop and the other of said first roller and said second roller rotatably through said operating gap.

8. The self-loading belt fusing apparatus of claim 1, including at least one heating element for heating said endless resilient belt hoop.

9. The self-loading belt fusing apparatus of claim 2, including a heat reflector mounted adjacent said at least one heating element for reflecting and concentrating heat from said at least one heating element to a desired portion of said endless resilient belt hoop.

10. The self-loading belt fusing apparatus of claim 2, wherein said heating element is located within a loop defined by said inner surface of said endless resilient belt hoop.

11. The self-loading belt fusing apparatus of claim 2, including a pair of said heating element.

12. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member for developing said latent electrostatic image on said imaging surface into a toner image;

(d) a transfer station for transferring said toner image from said imaging surface onto a toner image carrying sheet; and (e) a self-loading belt fusing apparatus including:

(i) a frame;

(ii) a first rotatable roller having a first outer surface and a first mounted position on said frame;

(iii) a second rotatable roller having a second outer surface, and a second mounted position on said frame spaced from said first mounted position of said first rotatable roller, said second outer surface and said first outer surface being spaced a first dimension from each other and defining an operating gap therebetween; and (iv) an endless resilient belt hoop having an inner surface, an external surface, an unloaded external diameter greater than said first dimension between said first outer surface and said second outer surface, and a loaded external dimension that is less than said unloaded external diameter, said endless resilient belt hoop being pinched-loaded into said operating gap by said first outer surface of said first roller and said second outer surface of said second roller, said endless resilient belt hoop, as pinch-loaded, acting as a hoop compression spring and forming a self-loading fusing nip with at least one of said first roller and said second roller.

13. The electrostatographic reproduction machine of claim 12, including first and second belt hoop guide baffles mounted adjacent portions of a path of said endless resilient belt hoop.

14. The electrostatographic reproduction machine of claim 12, including an endless belt hoop guide at each end of first roller and the second roller.

15. The electrostatographic reproduction machine of claim 12, wherein said endless resilient belt hoop is made of a heat conductive material.

16. The electrostatographic reproduction machine of claim 12, wherein one of said first roller and said second roller is a drive roller for moving said endless resilient belt hoop and the other of said first roller and said second roller rotatably through said operating gap.

17. The electrostatographic reproduction machine of claim 12, wherein said self-loading belt fusing apparatus includes at least one heating element for heating said endless resilient belt hoop.

18. The electrostatographic reproduction machine of claim 17, wherein said second mounted position of said second roller is adjustable relative to said first mounted position of said first roller for loading said endless resilient belt hoop within said operating gap.

19. The electrostatographic reproduction machine of claim 17, including a heat reflector mounted adjacent said at least one heating element for reflecting and concentrating heat from said at least one heating element to a desired portion of said endless resilient belt hoop.

20. The electrostatographic reproduction machine of claim 17, wherein said heating element is located within a loop defined by said inner surface of said endless resilient belt hoop.

* * * * *